US009437212B1

(12) United States Patent
Jain

(10) Patent No.: US 9,437,212 B1
(45) Date of Patent: Sep. 6, 2016

(54) SYSTEMS AND METHODS FOR SUPPRESSING NOISE IN AN AUDIO SIGNAL FOR SUBBANDS IN A FREQUENCY DOMAIN BASED ON A CLOSED-FORM SOLUTION

(71) Applicant: Marvell International Ltd., Hamilton (BM)

(72) Inventor: Kapil Jain, Santa Clara, CA (US)

(73) Assignee: MARVELL INTERNATIONAL LTD., Hamilton (BM)

( * ) Notice: Subject to any disclaimer, the term of this patent is extended or adjusted under 35 U.S.C. 154(b) by 14 days.

(21) Appl. No.: 14/546,552

(22) Filed: Nov. 18, 2014

Related U.S. Application Data

(60) Provisional application No. 61/916,622, filed on Dec. 16, 2013.

(51) Int. Cl.

| | |
|---|---|
| ***G10L 21/02*** | (2013.01) |
| ***G10L 21/0216*** | (2013.01) |
| ***G10L 21/0232*** | (2013.01) |
| ***G10L 21/0208*** | (2013.01) |

(52) U.S. Cl.
CPC ..... *G10L 21/0208* (2013.01)

(58) Field of Classification Search
CPC ..... G10L 19/02; G10L 19/03; G10L 21/02; G10L 21/0216; G10L 21/0232; G10L 21/0264
USPC ..... 704/205, 206, 226, 227, 228; 381/94.2, 381/94.3
See application file for complete search history.

(56) References Cited

U.S. PATENT DOCUMENTS 4,897,878 A * 1/1990 Boll ..... G10L 15/20 704/233
5,012,519 A * 4/1991 Adlersberg ..... G10L 21/0208 704/225
5,577,161 A * 11/1996 Pelaez Ferrigno . G10L 21/0208 704/211
6,249,762 B1 * 6/2001 Kirsteins ..... H04L 25/03006 704/233
7,885,810 B1 * 2/2011 Wang ..... G10L 21/0208 704/219
8,098,842 B2 * 1/2012 Florencio ..... H04R 3/005 704/226
8,180,069 B2 * 5/2012 Buck ..... H04R 3/005 704/226
8,560,320 B2 * 10/2013 Yu ..... G10L 19/0204 704/226
2002/0002455 A1 * 1/2002 Accardi ..... G10L 21/0208 704/226
2003/0040908 A1 * 2/2003 Yang ..... H04R 3/005 704/233
2004/0052383 A1 * 3/2004 Acero ..... G10L 21/0208 381/94.1
2004/0071284 A1 * 4/2004 Abutalebi ..... G10L 21/0208 379/406.08

(Continued)

OTHER PUBLICATIONS

Ephraim et al., "Speech Enhancement Using a Minimum Mean-Square Error Short-Time Spectral Amplitude Estimator", IEEE Transactions on Acoustics, Speech, and Signal Processing, vol. ASSP-32, No. 6, Dec. 1984, pp. 1109 to 1121.*

(Continued)

*Primary Examiner* — Martin Lerner

(57) ABSTRACT

Systems and methods for reducing noise from an input signal are provided. An input signal is received. The input signal is transformed from a time domain to a plurality of subbands in a frequency domain, where each subband of the plurality of subbands includes a speech component and a noise component. For each of the subbands, an amplitude of the speech component is estimated based on an amplitude of the subband and an estimate of at least one signal-to-noise ratio (SNR) of the subband. The estimating of the amplitude of the speech component is based on a closed-form solution. The plurality of subbands in the frequency domain are filtered based on the amplitudes of the speech components.

19 Claims, 5 Drawing Sheets

(56) References Cited

U.S. PATENT DOCUMENTS

2005/0027520 A1* 2/2005 Mattila ..... G10L 21/0208 704/228
2005/0261894 A1* 11/2005 Balan ..... G10L 21/0208 704/205
2006/0206322 A1* 9/2006 Deng ..... G10L 21/0208 704/226
2007/0055505 A1* 3/2007 Doclo ..... G10L 21/0208 704/226
2007/0106504 A1* 5/2007 Deng ..... G10L 21/0208 704/226
2008/0167866 A1* 7/2008 Hetherington ..... G10L 21/0208 704/228
2009/0177468 A1* 7/2009 Yu ..... G10L 15/02 704/233
2009/0292536 A1* 11/2009 Hetherington ..... G10L 19/012 704/225
2010/0145687 A1* 6/2010 Huo ..... G10L 21/0208 704/206
2012/0123772 A1* 5/2012 Thyssen ..... G10L 21/0208 704/226

OTHER PUBLICATIONS

Wolfe et al., "Efficient Alternatives to the Ephraim and Malah Suppression Rule for Audio Singal Enhancement", EURASIP Journal on Applied Signal Processing 2003: 10, pp. 1043 to 1051.*

* cited by examiner

SYSTEMS AND METHODS FOR SUPPRESSING NOISE IN AN AUDIO SIGNAL FOR SUBBANDS IN A FREQUENCY DOMAIN BASED ON A CLOSED-FORM SOLUTION

CROSS-REFERENCE TO RELATED APPLICATIONS

This disclosure claims priority to U.S. Provisional Patent Application No. 61/916,622, filed on Dec. 16, 2013, which is incorporated herein by reference in its entirety.

TECHNICAL FIELD

The technology described in this document relates generally to audio signal processing and more particularly to systems and methods for reducing background noise in an audio signal.

BACKGROUND

Noise suppression systems including computer hardware and/or software are used to improve the overall quality of an audio sample by distinguishing the desired signal from ambient background noise. For example, in processing audio samples that include speech, it is desirable to improve the signal noise ratio (SNR) of the speech signal to enhance the intelligibility and/or perceived quality of the speech. Enhancement of speech degraded by noise is an important field of speech enhancement and is used in a variety of applications (e.g., mobile phones, voice over IP, teleconferencing systems, speech recognition, and hearing aids). Such speech enhancement may be particularly useful in processing audio samples recorded in environments having high levels of ambient background noise, such as an aircraft, a vehicle, or a noisy factory.

SUMMARY

The present disclosure is directed to systems and methods for reducing noise from an input signal to generate noise-reduced output signal. In an example method of reducing noise from an input signal to generate a noise-reduced output signal, an input signal is received. The input signal is transformed from a time domain to a plurality of subbands in a frequency domain, where each subband of the plurality of subbands includes a speech component and a noise component. For each of the subbands, an amplitude of the speech component is estimated based on an amplitude of the subband and an estimate of at least one signal-to-noise ratio (SNR) of the subband. The estimating of the amplitude of the speech component is not based on an exponential function or a Bessel function. The estimating of the amplitude of the speech component is based on a closed-form solution. The plurality of subbands in the frequency domain are filtered based on the estimated amplitudes of the speech components to generate the noise-reduced output signal.

An example system for reducing noise from an input signal to generate a noise-reduced output signal includes a time-to-frequency transformation device. The time-to-frequency transformation device is configured to transform an input signal from a time domain to a plurality of subbands in the frequency domain, where each subband of the plurality of subbands includes a speech component and a noise component. The system further includes a filter coupled to the time-to-frequency device. The filter is configured, for each of the subbands, to estimate an amplitude of the speech component based on an amplitude of the subband and an estimate of at least one signal-to-noise ratio (SNR) of the subband. The estimating of the amplitude of the speech component is not based on an exponential function or a Bessel function. The estimating of the amplitude of the speech component is based on a closed-form solution. The filter is also configured to filter the plurality of subbands in the frequency domain based on the estimated amplitudes of the speech components to generate the noise-reduced output signal. The system also includes a frequency-to-time transformation device configured to transform the noise-reduced output signal from the frequency domain to the time domain.

In another example, a filter includes an input for receiving an input signal in a frequency domain. The input signal includes a plurality of subbands in the frequency domain, where each subband of the plurality of subbands includes a speech component and a noise component. The filter also includes an attenuation filter coupled to the input. The attenuation filter is configured to attenuate frequencies in the input signal based on $$\hat{A}_k = \frac{\left|\sqrt[2]{v_k(1+v_k)}\right|}{\gamma_k}|Y_k|,$$

where $\hat{A}_k$ is an estimate of an amplitude of the speech component for a subband k of the plurality of subbands, $\gamma_k$ is an estimate of an a posteriori SNR of the subband k, $Y_k$ is an amplitude of the subband k, and $v_k$ is $$v_k = \frac{\xi_k}{1+\xi_k}\gamma_k,$$

where $\xi_k$ is an estimate of an a priori SNR of the subband k. The filter also includes an output coupled to the attenuation filter for outputting a noise-reduced output signal.

DETAILED DESCRIPTION

Figure 1:
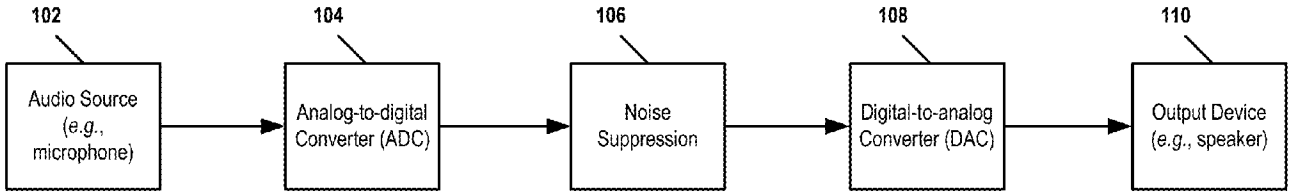
FIG. 1 depicts an example system for speech acquisition and noise suppression.

FIG. 1 depicts an example system for speech acquisition and noise suppression. In FIG. 1, a microphone 102 converts sound waves into electrical signals, and an output from the microphone 102 is received by an analog-to-digital converter (ADC) 104. In FIG. 1, the sound waves received by the microphone 102 include speech from a human being.

The ADC 104 converts the analog signal received from the microphone 102 into a digital representation that can be processed further by hardware and/or computer software. In an example, the microphone 102 is located in a noisy environment, such that the sound waves received by the microphone 102 include both desired speech (i.e., "clean speech") and undesired noise from the ambient environment. In the example, it is assumed that the noise from the ambient environment is uncorrelated with the desired speech components received at the microphone 102.

Noise suppression filter system 106 is used to lower the noise in the input signal. The noise suppression filter system 106 may be understood as performing "speech enhancement" because suppressing the noise in the input signal may enhance the intelligibility and/or perceived quality of the speech components of the signal. The noise suppression filter system 106, described in greater detail below with reference to FIG. 2, filters the digital signal received from the ADC 104 to suppress noise in the digital signal and outputs the filtered signal to a digital-to-analog converter (DAC) 108. The DAC 108 converts the filtered digital signal to an analog signal, and the analog signal is used to drive an output device 110. In an example, the output device 110 is a speaker or other playback device. It should be understood that the example system of FIG. 1 may include one or more storage devices (e.g., non-transitory computer-readable storage media) for storing the speech signal at various stages of its processing.

Figure 2:
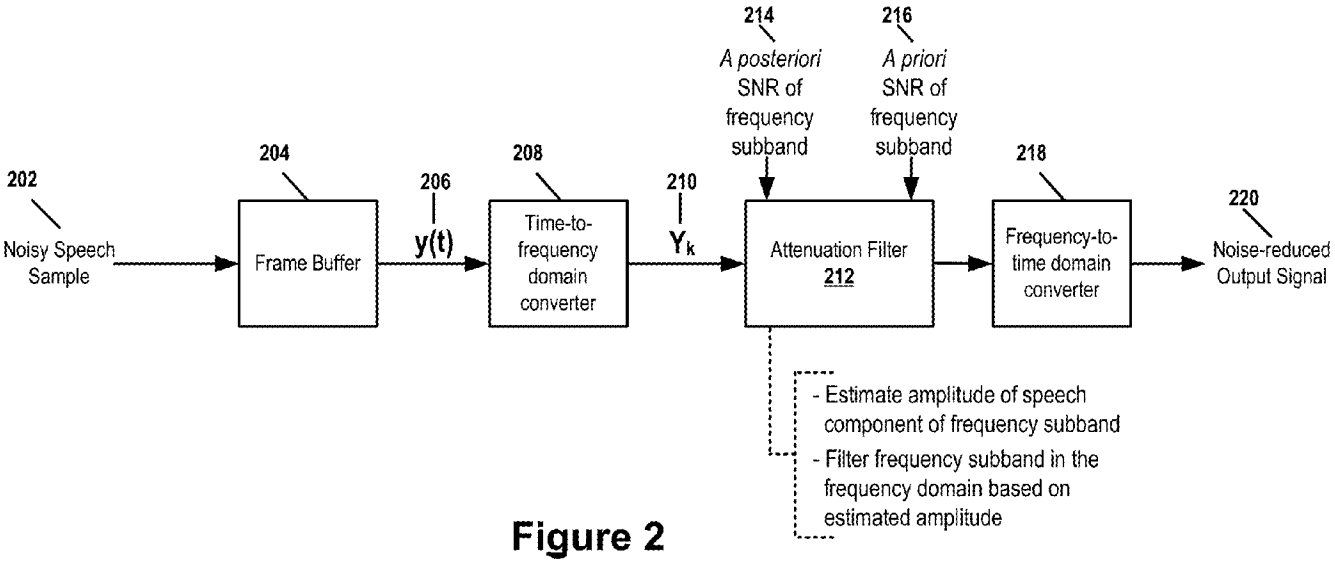
FIG. 2 depicts an example noise suppression filter system.

Example features of the noise suppression filter system 106 of FIG. 1 are illustrated in FIG. 2. The example noise suppression filter system of FIG. 2 is used to suppress noise in a noisy speech sample 202 to generate a noise-reduced output signal 220. The noisy speech sample 202 is received at a frame buffer 204 from an ADC (e.g., the ADC 104 of FIG. 1) or another component (e.g., a non-transitory computer-readable storage medium storing the sample 202). The noisy speech sample 202 includes both clean speech and noise. The frame buffer 204 partitions (i.e., segments) the noisy speech sample 202 into overlapping or non-overlapping frames of relatively short time durations. In an example, frames output by the frame buffer 204 have a duration of 15 ms, 20 ms, or 30 ms, although frames of other durations are used in other examples. The frames output by the frame buffer 204 are represented in FIG. 2 as signal y(t) 206. The variable "t" of the signal y(t) 206 represents time and indicates that the frames comprise a time domain representation of the input signal 202.

The time domain signal y(t) 206 is received at a time-to-frequency domain converter 208. In an example, the time-to-frequency domain converter 208 comprises hardware and/or computer software for converting the frames of the signal y(t) 206 from the time domain to the frequency domain. The time-to-frequency domain conversion is achieved in the converter 208, for example, using a Fast Fourier Transform (FFT) algorithm, a short-time Fourier transform (STFT) (i.e., short-term Fourier transform) algorithm, or another algorithm (e.g., an algorithm that performs a discrete Fourier transform mathematical process). The conversion of the frames from the time domain to the frequency domain permits analysis and filtering of the speech sample to occur in the frequency domain, as explained in further detail below. In an example, the time-to-frequency domain converter 208 operates on individual frames of the signal y(t) 206 and determines the Fourier transform of each frame individually using the STFT algorithm.

The time-to-frequency domain converter 208 converts each frame of the signal 206 into K subbands in the frequency domain and determines amplitude values $Y_k$ 210, k=1, . . . , K. The amplitude values $Y_k$ 210 are amplitude values for each of the K frequency subbands. For example, if a frequency domain representation of a frame includes frequency components over a range of 0 Hz to 20 kHz, and if each subband has a width of 20 Hz, then K=1,000, and the amplitude values $Y_k$ 210 include one thousand (1,000) amplitude values, with each of the K subbands being associated with an amplitude value. In this example, a first subband has an amplitude value (e.g., $Y_1$) for frequency components ranging from 0 to 20 Hz, a second subband has an amplitude value (e.g., $Y_2$) for frequency components ranging from 20 Hz to 40 Hz, and so on. Each frequency subband includes a speech component and a noise component.

Figure 3:
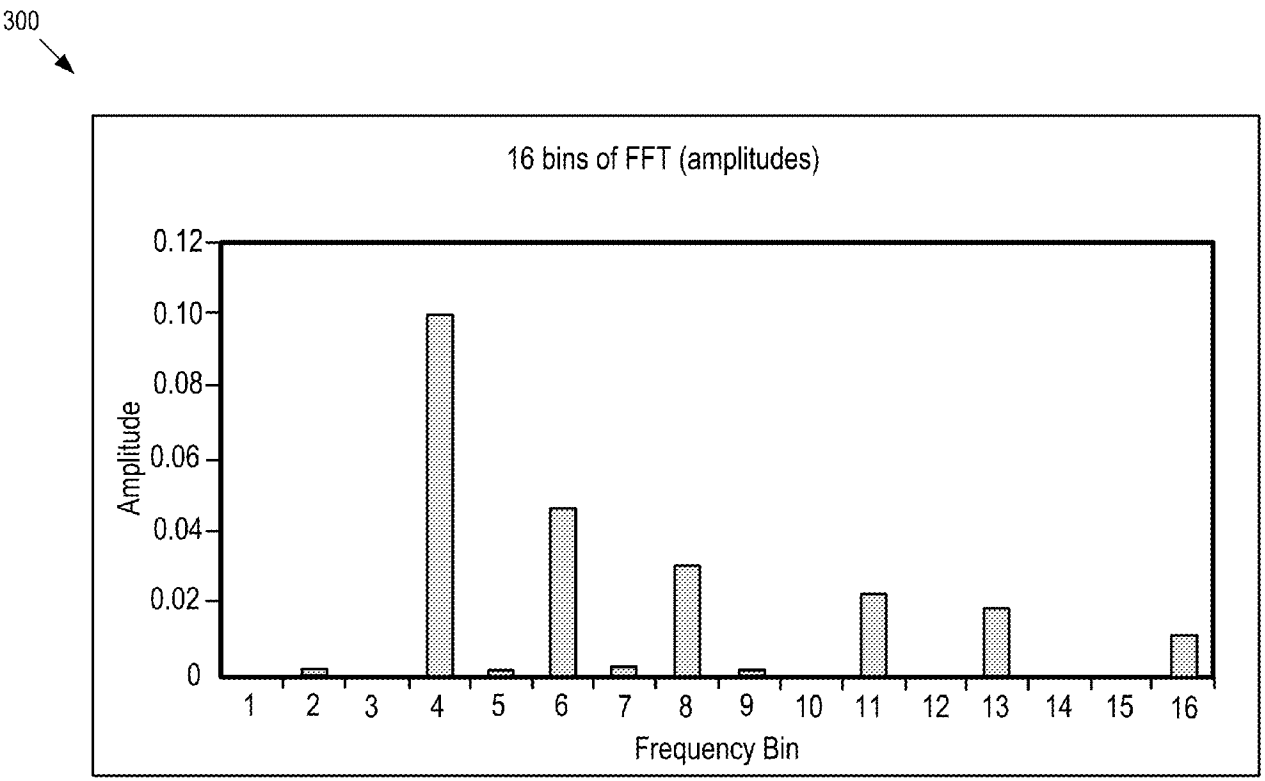
FIG. 3 is an example graph showing amplitude values for sixteen frequency bins of a frequency domain audio signal.

The frequency subbands may be known as "frequency bins." FIG. 3 is an example graph 300 showing amplitude values for sixteen frequency bins (i.e., sixteen subbands) of an audio frame that has been converted to the frequency domain. In the example of FIG. 3, a bin resolution of 2 Hz, 4 Hz, 5 Hz, or 20 Hz is used, such that each of the frequency bins covers a range of frequencies that is equal to the bin resolution. Bin resolutions other than 2 Hz, 4 Hz, 5 Hz, or 20 Hz are used in other examples. In the example described above, where the frequency domain representation of the frame includes frequency components over a range of 0 Hz to 20 kHz and each subband has a width of 20 Hz, the frequency bin "1" of the graph 300 includes frequency components ranging from 0 to 20 Hz, the frequency bin "2" includes frequency components ranging from 20 to 40 Hz, and so on.

With reference again to FIG. 2, an attenuation filter 212 receives the amplitude values $Y_k$ 210 and performs filtering of the speech sample in the frequency domain based on the amplitude values. As explained above, each frequency subband includes a speech component and a noise component. The attenuation filter 212 considers one particular frequency subband at a time (e.g., a k-th subband) and uses the amplitude value $Y_k$ for the particular subband to estimate an amplitude of the speech component for the subband. Specifically, the attenuation filter 212 estimates the amplitude of the speech component for the particular subband based on i) the amplitude value $Y_k$ for the particular subband, ii) an a posteriori signal-to-noise ratio (SNR) of the particular subband 214, and iii) an a priori SNR of the particular subband 216. The a posteriori and a priori SNR values 214, 216 are described in further detail below with reference to FIG. 4.

In an example, the estimating of the amplitude of the speech component is based on a simple function having few terms. The simple function (described in further detail below) is in contrast to the complex mathematical functions that are used in conventional speech enhancement systems. Such complex mathematical functions may be based on exponential functions, gamma functions, and modified Bessel functions, among others, that are difficult and costly to implement in hardware. By contrast, the attenuation filter 212 described herein utilizes the aforementioned simple function that includes few terms and does not require solving exponential functions, gamma functions, and modified Bessel functions. The attenuation filter 212 described herein is based on a closed-form solution (e.g., a non-infinite order polynomial function). The simple function described herein can be efficiently implemented in hardware. The hardware implementation may include, for example, a computer processor, a non-transitory computer-readable storage medium (e.g., a memory device), and additional components (e.g., multiplier, divider, and adder components implemented in hardware, etc.). It should be understood that the function used in estimating the amplitude of the speech component may be implemented in hardware in a variety of different ways.

Based on the estimates of the amplitudes of the speech components for each of the plurality of frequency subbands for the frame, the attenuation filter 212 filters the plurality of frequency subbands. The attenuation filter 212 thus performs frequency domain filtering on the input signals and the result is transformed back into the time domain using a frequency-to-time domain converter 218. The output of the frequency-to-time domain converter 218 is the noise-reduced output signal 220. The noise-reduced output signal 220 varies from the noisy speech sample 202 because frequencies of the noisy speech sample 202 determined to have high noise levels are suppressed in the noise-reduced output signal 220. In an example, the frequency-to-time domain converter 218 includes hardware and/or computer software for generating the noise-reduced output signal 220 based on an inverse Fourier transform operation.

Figure 4:
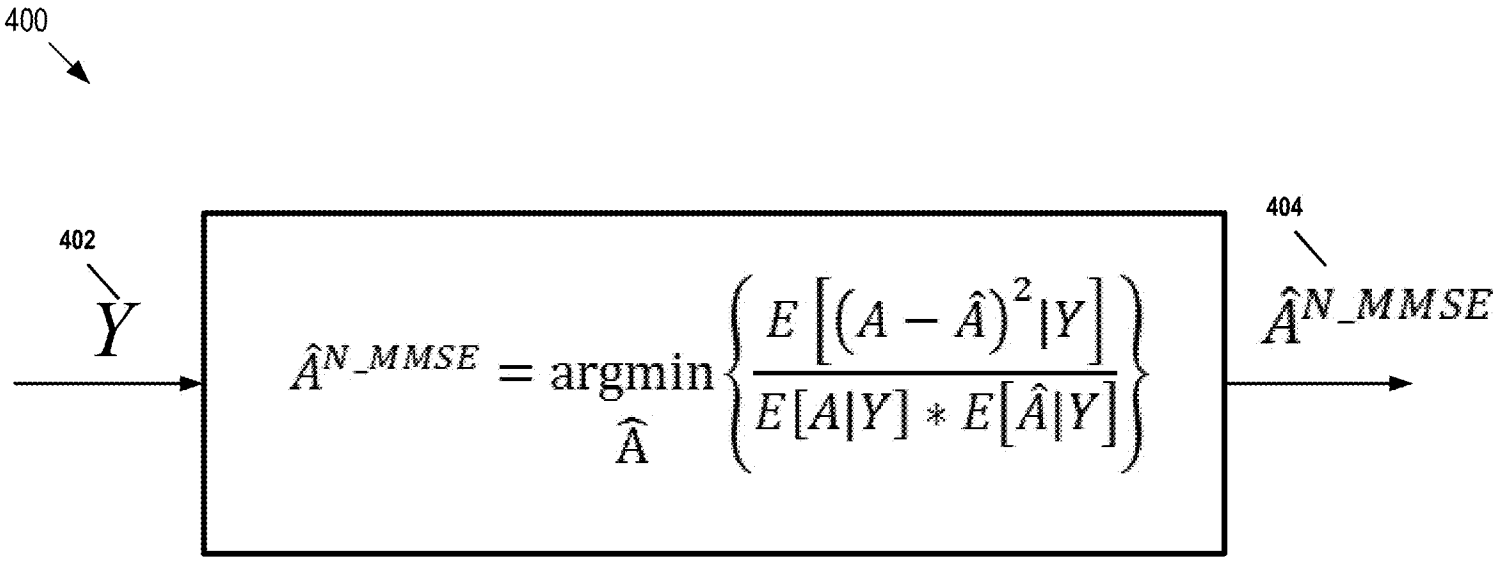
FIG. 4 depicts an example spectral amplitude estimator that is based on a minimization of a normalized mean squared error.

FIG. 4 depicts an example spectral amplitude estimator 400 that is based on a minimization of a normalized mean squared error. The spectral amplitude estimator 400 receives an input Y 402 and generates an output $\hat{A}^{N_MMSE}$ 404. In FIG. 4, the input and output values 402, 404 are associated with a particular frequency subband (i.e., a particular frequency bin). Although the input and output 402, 404 are not written herein as $Y_k$ and $\hat{A}_k^{N_MMSE}$ (i.e., to indicate that they are associated with a particular k-th frequency subband), respectively, it should nevertheless be understood that these values 402, 404 are associated with the particular frequency subband. Thus, the spectral amplitude estimator 400 focuses on a single frequency subband at a time, accepting an input 402 for the particular frequency subband and generating an output 404 for the particular frequency subband. The particular frequency subband includes a speech component and a noise component. The speech component represents the clean speech included in the input 402, and the noise component represents the undesired noise included in the input 402.

The input Y 402 is an amplitude value for the particular frequency subband, where the particular frequency subband is part of a frequency domain representation of a noisy speech sample. The input Y 402 is similar to one of the amplitude values $Y_k$ 210, k=1, . . . , K, described above with reference to FIG. 2. Specifically, the determination of the input Y 402 is similar to the determination of the $Y_k$ 210 values of FIG. 2 and includes i) receiving a noisy speech sample in the time domain, ii) segmenting the noisy speech sample into a plurality of frames, and iii) transforming each frame from the time domain to a plurality of subbands in the frequency domain, with the input Y 402 being an amplitude value for the particular frequency subband of the plurality of subbands. In an example where the STFT algorithm is used in performing the time-to-frequency domain conversion, the input Y 402 is an amplitude of the STFT output for the particular frequency bin.

The output $\hat{A}^{N_MMSE}$ 404 of the spectral amplitude estimator 400 is an estimated amplitude of the speech component of the particular subband. Determining the output $\hat{A}^{N_MMSE}$ 404 is based on a minimization of a normalized mean squared error. As illustrated in FIG. 4, the normalized mean squared error is based on a mean squared error represented by $E[(A-\hat{A})^2|Y]$, where Y is the input 402 representing the amplitude of the subband, $\hat{A}$ represents the estimated amplitude of the speech component of the subband, A represents an actual value of the amplitude of the speech component, and E is an expected value operator. The actual value A is an unknown value The output $\hat{A}^{N_MMSE}$ 404 of the spectral amplitude estimator 400 is the value of $\hat{A}$ that minimizes $$\frac{E[(A-\hat{A})^2 \mid Y]}{E[A \mid Y] * E[\hat{A} \mid Y]}, \qquad \text{Equation 1}$$

where $E[A|Y]*E[\hat{A}|Y]$ is a term that normalizes the mean squared error represented by $E[(A-\hat{A})^2|Y]$. The spectral amplitude estimator 400 of FIG. 4 differs from conventional spectral amplitude estimators that are based on un-normalized minimum mean squared error (MMSE) values. Such conventional spectral amplitude estimators are commonly referred to as MMSE estimators and are known by those of ordinary skill in the art.

To determine the value of $\hat{A}$ that minimizes Equation 1, the derivative of Equation 1 is taken with respect to $\hat{A}$ as follows:

$$\begin{aligned}
&\frac{d}{d\hat{A}}\left[\left\{\frac{E[(A-\hat{A})^2 \mid Y]}{E[A \mid Y] * E[\hat{A} \mid Y]}\right\}\right] \qquad \text{Equation 2}\\
&= \frac{d}{d\hat{A}}\left[\left\{\frac{E[A^2 \mid Y] + \hat{A}^2 - 2\hat{A}E[A \mid Y]}{E[A \mid Y] * \hat{A}}\right\}\right]\\
&= \frac{\left[\frac{d}{d\hat{A}}\{E[A^2 \mid Y] + \hat{A}^2 - 2\hat{A}E[A \mid Y]\}\right] * [E[A \mid Y] * \hat{A}] - \left[\frac{d}{d\hat{A}}\{E[A \mid Y] * \hat{A}\}\right] * [E[A^2 \mid Y] + \hat{A}^2 - 2\hat{A}E[A \mid Y]]}{[E[A \mid Y] * \hat{A}]^2}\\
&= \frac{[0 + 2\hat{A} - 2E[A \mid Y]] * [E[A \mid Y] * \hat{A}] - [E[A \mid Y]] * [E[A^2 \mid Y] + \hat{A}^2 - 2\hat{A}E[A \mid Y]]}{[E[A \mid Y] * \hat{A}]^2}
\end{aligned}$$

Equation 2 is set equal to zero to determine a value of $\hat{A}$ that minimizes Equation 1, as follows:

$$\begin{aligned}
&\frac{[0 + 2\hat{A} - 2E[A \mid Y]] * [E[A \mid Y] * \hat{A}] - [E[A \mid Y]] * [E[A^2 \mid Y] + \hat{A}^2 - 2\hat{A}E[A \mid Y]]}{[E[A \mid Y] * \hat{A}]^2} = 0 \qquad \text{Equation 3}\\
&[2\hat{A} - 2E[A \mid Y]] * [E[A \mid Y] * \hat{A}] - [E[A \mid Y]] * [E[A^2 \mid Y] + \hat{A}^2 - 2\hat{A}E[A \mid Y]] = 0\\
&[2\hat{A} - 2E[A \mid Y]] * \hat{A} - [E[A^2 \mid Y] + \hat{A}^2 - 2\hat{A}E[A \mid Y]] = 0\\
&2\hat{A}^2 - 2\hat{A}\,E[A \mid Y] - E[A^2 \mid Y] - \hat{A}^2 + 2\hat{A}E[A \mid Y] = 0\\
&\hat{A}^2 - E[A^2 \mid Y] = 0\\
&\hat{A}^2 = E[A^2 \mid Y]\\
&\hat{A} = \sqrt[2]{E[A^2 \mid Y]}.
\end{aligned}$$

Although the value Y is known (i.e., the value Y is the input 402 received by the spectral amplitude estimator), A is an unknown value representing the actual value of the amplitude of the speech component, as noted above. Thus, additional transformation of Equation 3 is used to eliminate this equation's dependence on A. In the additional transformation, because Â is always positive, Equation 3 is rewritten as $$\hat{A}^{N_MMSE} = \left|\sqrt[2]{E[A^2 \mid Y]}\right|, \qquad \text{Equation 4}$$

where $\hat{A}^{N_MMSE}$ is the value of Â that minimizes Equation 1.

The expectation term of Equation 4 is evaluated as a function of an assumed probabilistic model and likelihood function. The assumed model utilizes asymptotic properties of the Fourier expansion coefficients. Specifically, the model assumes that the Fourier expansion coefficients of each process can be modeled as statistically independent Gaussian random variables. The mean of each coefficient is assumed to be zero, since the processes involved here are assumed to have zero mean. The variance of each speech Fourier expansion coefficient is time-varying due to speech non-stationarity. Thus, the expectation term of Equation 4 is evaluated as a function of the assumed probabilistic model and likelihood function:

$$E[A^2|Y]=\int_0^\infty A^2 p(A|Y)dA. \qquad \text{Equation 5}$$

The term p(A|Y) is a probability density function of A given Y. Using Bayes' theorem, Equation 5 can be rewritten to include a probability density function of Y given A, as follows:

$$E[A^2|Y]] = \int_0^\infty A^2 \frac{p(Y \mid A)p(A)}{p(Y)} dA. \qquad \text{Equation 6}$$

Based on the assumed probabilistic model for speech and additive noise, terms of Equation 6 are as follows:

$$p(Y \mid A) = \frac{1}{\pi\lambda_N}\exp\left(-\frac{|Y|^2 + A^2}{\lambda_N}\right) I_o\left(\frac{2|Y|A}{\lambda_N}\right), \qquad \text{Equation 6.1}$$

$$p(A) = \frac{2A}{\lambda_X}\exp\left(\frac{-A^2}{\lambda_x}\right), \qquad \text{Equation 6.2}$$

$$p(Y) = \frac{1}{\pi(\lambda_N + \lambda_X)}\exp\left(\frac{-|Y|^2}{\lambda_N + \lambda_X}\right), \qquad \text{Equation 6.3}$$

where $I_0$ is the modified Bessel function of order zero, $\lambda_N$ is a variance of noise for the particular frequency subband being considered, and $\lambda_X$ is a variance of clean speech for the particular frequency subband. One or more assumptions regarding the probabilistic model of speech may be used in estimating the values of $\lambda_N$ and $\lambda_X$. For example, it may be assumed that clean speech has some mean and variance and that clean speech follows a Gaussian distribution. Further, it may be assumed that noise has some other mean and variance and that noise also follows a Gaussian distribution. Equation 6.1 is a probability density function of Y given A, Equation 6.2 is a probability density function of A, and Equation 6.3 is a probability density function of Y. Substituting Equations 6.1, 6.2, and 6.3 into Equation 6 yields the following:

$$E[A^2 \mid Y] = \int_0^\infty A^2 \frac{\left[\frac{1}{\pi\lambda_N}\exp\left(-\frac{|Y|^2 + A^2}{\lambda_N}\right) I_o\left(\frac{2|Y|A}{\lambda_N}\right)\right]\left[\frac{2A}{\lambda_X}\exp\left(\frac{-A^2}{\lambda_x}\right)\right]}{A} dA$$

$$= \frac{\frac{1}{\pi\lambda_N}\cdot\frac{2}{\lambda_X}}{\frac{1}{\pi(\lambda_N + \lambda_X)}} \int_0^\infty A^2 \frac{\left[\exp\left(-\frac{|Y|^2 + A^2}{\lambda_N}\right) I_o\left(\frac{2|Y|A}{\lambda_N}\right)\right]\left[A\exp\left(\frac{-A^2}{\lambda_x}\right)\right]}{\exp\left(\frac{-|Y|^2}{\lambda_N + \lambda_X}\right)} dA$$

$$= \frac{\frac{1}{\pi\lambda_N}\cdot\frac{2}{\lambda_X}}{\frac{1}{\pi(\lambda_N + \lambda_X)}} \int_0^\infty A^2 \frac{\left[\exp\left(-\frac{|Y|^2 + A^2}{\lambda_N}\right) I_o\left(\frac{2|Y|A}{\lambda_N}\right)\right]\left[A\exp\left(\frac{-A^2}{\lambda_x}\right)\right]}{\exp\left(\frac{-|Y|^2}{\lambda_N + \lambda_X}\right)} dA$$

$$= \frac{2(\lambda_N + \lambda_X)}{\lambda_N\lambda_X}\exp\left(\frac{-|Y|^2}{\lambda_N} + \frac{|Y|^2}{\lambda_N + \lambda_X}\right)\int_0^\infty A^3\exp\left(-\frac{A^2}{\lambda_N} - \frac{A^2}{\lambda_x}\right) I_o\left(\frac{2|Y|A}{\lambda_N}\right) dA$$

$$= \frac{2(\lambda_N + \lambda_X)}{\lambda_N\lambda_X}\exp\left(\frac{-|Y|^2\lambda_X}{\lambda_N(\lambda_N + \lambda_X)}\right)\int_0^\infty A^3\exp\left(-A^2\left(\frac{\lambda_X + \lambda_N}{\lambda_N\lambda_x}\right)\right) I_o\left(\frac{2|Y|A}{\lambda_N}\right) dA$$

$$E[A^2 \mid Y] = 2\alpha\exp\left(\frac{\beta^2}{4\alpha}\right)\int_0^\infty A^3\exp(-A^2\alpha) I_o(-i\beta A) dA, \qquad \text{Equation 7}$$

where $$\alpha = \frac{\lambda_N + \lambda_X}{\lambda_N\lambda_X}, \qquad \text{Equation 8}$$

$$-i\beta = \frac{2|Y|}{\lambda_N}. \qquad \text{Equation 9}$$

The integral in Equation 7 can be calculated based on the following formulas:

$$\int_0^\infty x^\mu e^{-\alpha x^2} J_\nu(\beta x)dx = \frac{\beta^\nu \Gamma\left(\frac{1}{2}\nu + \frac{1}{2}\mu + \frac{1}{2}\right)}{2^{\nu+1}\alpha^{\frac{1}{2}(\mu+\nu+1)}\Gamma(\nu+1)} {}_1F_1\left(\frac{\nu+\mu+1}{2}; \nu+1; -\frac{\beta^2}{4\alpha}\right)$$

$$= \frac{\Gamma\left(\frac{1}{2}\nu + \frac{1}{2}\mu + \frac{1}{2}\right)}{\beta\alpha^{\frac{1}{2}\mu}\Gamma(\nu+1)} \exp\left(-\frac{\beta^2}{8\alpha}\right) M_{\frac{1}{2}\mu,\frac{1}{2}\nu}\left(\frac{\beta^2}{4\alpha}\right)$$

[Re $\alpha > 0$, Re$(\mu + \nu) > -1$]

For Integer $\nu$, $I_n(z) = i^{-n} J_n(iz)$.

Specifically, using the above formulas, the integral of Equation 7 is rewritten as follows:

$$\int_0^\infty A^3 \exp(-A^2\alpha) I_o(-i\beta A)dA = \frac{\Gamma(2)}{2\alpha^2\Gamma(1)} F_1\left(2, 1, -\frac{\beta^2}{4\alpha}\right), \quad \text{Equation 10}$$

where $\Gamma$ is the gamma function and $F_1$ is the confluent hypergeometric function. The gamma function is defined as $$\Gamma(z)=\int_0^\infty e^{-t}t^{z-1}dt. \ [Re\ z>0] \quad \text{Equation 10.1}$$

Some particular values of the gamma function are $$\Gamma(2)=\Gamma(1)=1. \quad \text{Equation 11}$$

The confluent hypergeometric function is defined based on a geometric series expansion as follows:

$$\Phi(\alpha, \gamma; z) = 1 + \frac{\alpha}{\gamma}\frac{z}{1!} + \frac{\alpha(\alpha+1)z^2}{\gamma(\gamma+1)2!} + \frac{\alpha(\alpha+1)(\alpha+2)z^3}{\gamma(\gamma+1)(\gamma+2)3!} + \ldots \quad \text{Equation 11.1}$$

In Equation 11.1, $\Phi(\alpha, \gamma; z)$ is equivalent to $F_1(\alpha; \gamma; z)$. Changing the notation of the confluent hypergeometric function as shown in Equation 11.1 and substituting Equations 10 and 11 into Equation 7 yields the following:

$$E[A^2 \mid Y] = 2\alpha\exp\left(\frac{\beta^2}{4\alpha}\right)\frac{\Gamma(2)}{2\alpha^2\Gamma(1)}\Gamma_1\left(2, 1, -\frac{\beta^2}{4\alpha}\right) \quad \text{Equation 12}$$

$$E[A^2 \mid Y] = \exp\left(\frac{\beta^2}{4\alpha}\right)\frac{1}{a}\Phi\left(2, 1, -\frac{\beta^2}{4\alpha}\right).$$

The confluent hypergeometric function has a property $\Phi(\alpha,\gamma;z)=e^z\Phi(\gamma-\alpha,\gamma;-z)$. Using this property, Equation 12 is rewritten as follows:

$$E[A^2 \mid Y] = \frac{1}{a}\Phi\left(-1, 1, \frac{\beta^2}{4\alpha}\right). \quad \text{Equation 13}$$

Parameters $\alpha$ and $\beta$, defined in Equations 8 and 9, respectively, are rewritten in terms of the a priori signal-to-noise ratio (SNR) $\xi$ of the particular frequency subband, the a posteriori SNR $\gamma$ of the particular subband, and a parameter $\nu$ for the particular frequency subband. Equations 14, 15, and 16 define the a priori SNR $\xi$, the a posteriori SNR $\gamma$, and the parameter $\nu$ for the particular frequency subband, respectively, and Equations 17 and 18 rewrite equations for the parameters $\alpha$ and $\beta$ in terms of $\xi$, $\gamma$, and $\nu$:

$$\xi = \frac{\lambda_X}{\lambda_N} \quad \text{Equation 14}$$

$$\gamma = \frac{|Y|^2}{\lambda_N} \quad \text{Equation 15}$$

$$\nu = \frac{\xi}{1+\xi}\gamma \quad \text{Equation 16}$$

$$-\nu = \frac{\beta^2}{4\alpha} \quad \text{Equation 17}$$

$$\frac{1}{\alpha} = \frac{\nu}{\gamma^2}|Y|^2. \quad \text{Equation 18}$$

Using the notation for parameters $\alpha$ and $\beta$ as shown in Equations 17 and 18, Equation 13 is rewritten as follows:

$$E[A^2 \mid Y] = \frac{\nu}{\gamma^2}|Y|^2\Phi(-1, 1, -\nu). \quad \text{Equation 19}$$

Based on Equation 11.1, the series expansion $\Phi(-1,1,-\nu)$ of Equation 19 simplifies to the following:

$$\Phi(-1,1,-\nu)=1+\nu \quad \text{Equation 20}$$

Substituting the expansion of Equation 20 into Equation 19 yields the following:

$$E[A^2 \mid Y] = \frac{\nu}{\gamma^2}(1+\nu)|Y|^2. \quad \text{Equation 21}$$

By inserting Equation 21 into Equation 4, the equation for the value of $\hat{A}$ that minimizes Equation 1 is rewritten as follows:

$$\hat{A}^{N_MMSE} = \left|\sqrt[2]{\frac{\nu}{\gamma^2}(1+\nu)|Y|^2}\right| \quad \text{Equation 22}$$

$$\hat{A}^{N_MMSE} = \frac{\left|\sqrt[2]{\nu(1+\nu)}\right|}{\gamma}|Y|.$$

In Equation 22, the term $$\frac{\left|\sqrt[2]{\nu(1+\nu)}\right|}{\gamma}$$

is a gain function $G^{N_{MMSE}}$, such that Equation 22 is rewritten as:

$$\hat{A}^{N_MMSE}=G^{N_{MMSE}}|Y|. \quad \text{Equation 23}$$

The value $\hat{A}^{N_MMSE}$ from Equations 22 and 23 is the output 404 of the spectral amplitude estimator 400 and is equal to the estimated amplitude of the speech component of the particular subband. The calculation of the value $\hat{A}^{N_MMSE}$ is performed for each subband of the plurality of frequency subbands corresponding to a frame of the input signal. Based on the estimates of the amplitudes of the speech components for each of the frequency subbands of the frame, the plurality of frequency subbands are filtered. Thus, as explained above with reference to FIG. 2, frequency domain filtering is performed on the input signal and the result is transformed back into the time domain using a frequency-to-time domain converter. These operations are performed for all frames of the input signal.

It should be appreciated that the spectral amplitude estimator 400 of FIG. 4, as implemented based on Equation 22, utilizes an extremely simple mathematical equation that can be efficiently implemented in hardware. Equation 22 is based on only i) the input Y 402, ii) the a posteriori SNR, iii) the a priori SNR, and iv) the variance of noise for the subband. The input Y 402 is determined directly from the frequency domain representation of the input signal and is thus a known value that is not based on an estimation. The a posteriori SNR, the a priori SNR, and the variance of noise are estimated, as described above. The estimation of the amplitude of the speech component carried out by spectral amplitude estimator 400 of FIG. 4 is not based on an exponential function, is not based on a Gamma function, and is not based on a Bessel function. This is in contrast to conventional amplitude estimators that utilize complex mathematical functions based on one or more of these functions. The estimation of the amplitude of the speech component carried out by spectral amplitude estimator 400 of FIG. 4 is based on a closed-form solution (e.g., a non-infinite order polynomial function).

Figure 5:
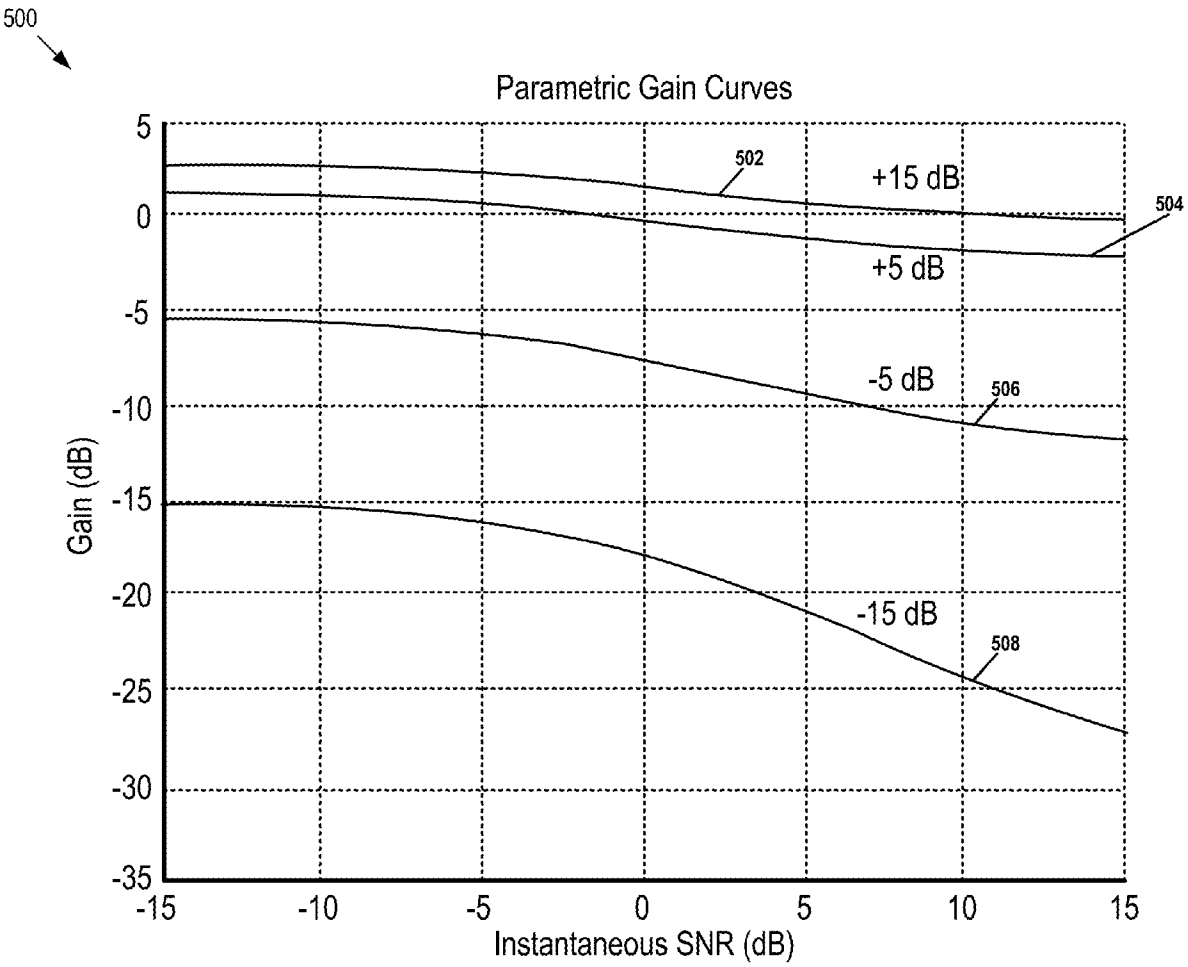
FIG. 5 is a graph showing example parametric gain curves for a spectral amplitude estimator that is based on a minimization of a normalized mean squared error.

FIG. 5 is a graph 500 showing example parametric gain curves for a spectral amplitude estimator that is based on a normalized minimum mean square error estimator. As described above with reference to FIG. 4, the output 404 of the spectral amplitude estimator 400 is based on a gain function $G^{N_{MMSE}}$ that is equal to $$\frac{\left|\sqrt[2]{v(1+v)}\right|}{\gamma}.$$

In FIG. 5, parametric gain curves 502, 504, 506, 508 represent the gain function $G^{N_{MMSE}}$ for different a priori SNR values. An x-axis, labeled "Instantaneous SNR (dB)" represents a posteriori SNR values, and a y-axis, labeled "Gain (dB)" represents values of the gain function $G^{N_{MMSE}}$ at the a posteriori SNR values. The gain curve 502 represents values of the gain function $G^{N_{MMSE}}$ for an a priori SNR equal to +15 dB. The gain curve 504 represents values of the gain function $G^{N_{MMSE}}$ for an a priori SNR equal to +5 dB. The gain curve 506 represents values of the gain function $G^{N_{MMSE}}$ for an a priori SNR equal to −5 dB. The gain curve 508 represents values of the gain function $G^{N_{MMSE}}$ for an a priori SNR equal to −15 dB.

Figure 6:
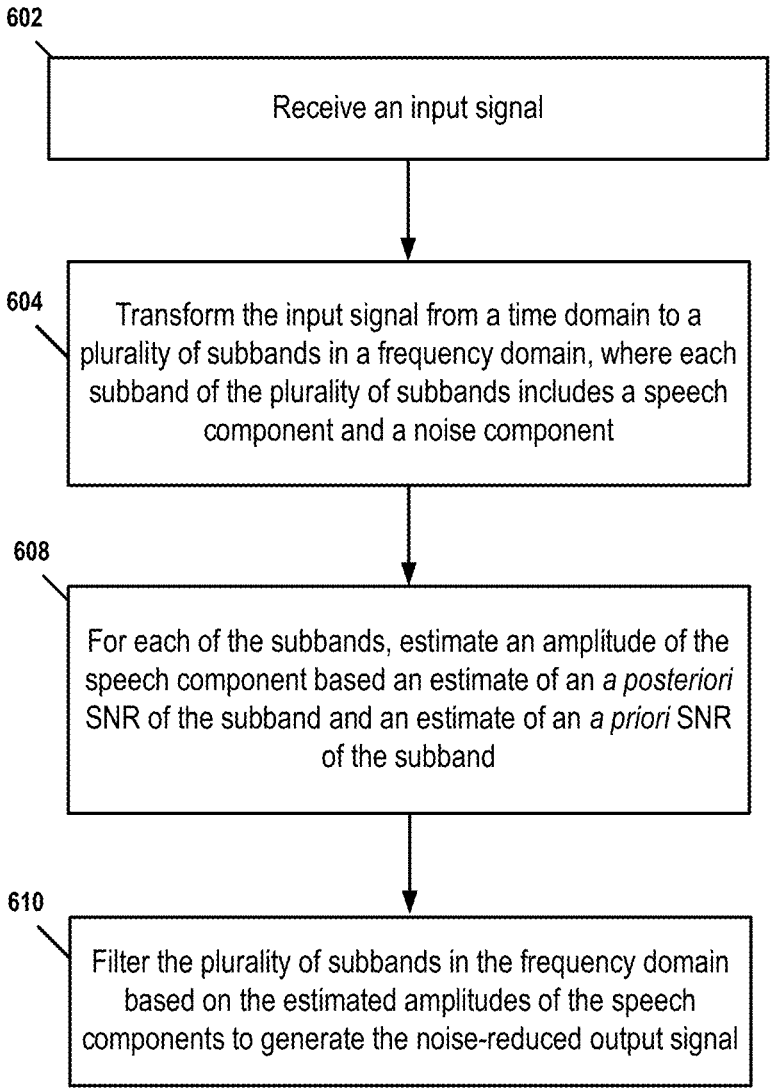
FIG. 6 is a flowchart illustrating an example method of reducing noise from an input signal to generate a noise-reduced output signal.

FIG. 6 is a flowchart illustrating an example method of reducing noise from an input signal to generate a noise-reduced output signal. At 602, an input signal is received. At 604, the input signal is transformed from a time domain to a plurality of subbands in a frequency domain, where each subband of the plurality of subbands includes a speech component and a noise component. At 608, for each of the subbands, an amplitude of the speech component is estimated based on an estimate of an a posteriori signal-to-noise ratio (SNR) of the subband, and an estimate of an a priori SNR of the subband. The estimating of the amplitude of the speech component is not based on an exponential function and is not based on a Bessel function. The estimating of the amplitude of the speech component is based on a closed-form solution. At 610, the plurality of subbands are filtered in the frequency domain based on the estimated amplitudes of the speech components to generate the noise-reduced output signal.

This written description uses examples to disclose the invention, including the best mode, and also to enable a person skilled in the art to make and use the invention. The patentable scope of the invention includes other examples. Additionally, the methods and systems described herein may be implemented on many different types of processing devices by program code comprising program instructions that are executable by the device processing subsystem. The software program instructions may include source code, object code, machine code, or any other stored data that is operable to cause a processing system to perform the methods and operations described herein. Other implementations may also be used, however, such as firmware or even appropriately designed hardware configured to carry out the methods and systems described herein.

The systems' and methods' data (e.g., associations, mappings, data input, data output, intermediate data results, final data results, etc.) may be stored and implemented in one or more different types of computer-implemented data stores, such as different types of storage devices and programming constructs (e.g., RAM, ROM, Flash memory, flat files, databases, programming data structures, programming variables, IF-THEN (or similar type) statement constructs, etc.). It is noted that data structures describe formats for use in organizing and storing data in databases, programs, memory, or other computer-readable media for use by a computer program.

The computer components, software modules, functions, data stores and data structures described herein may be connected directly or indirectly to each other in order to allow the flow of data needed for their operations. It is also noted that a module or processor includes but is not limited to a unit of code that performs a software operation, and can be implemented for example as a subroutine unit of code, or as a software function unit of code, or as an object (as in an object-oriented paradigm), or as an applet, or in a computer script language, or as another type of computer code. The software components and/or functionality may be located on a single computer or distributed across multiple computers depending upon the situation at hand.

It should be understood that as used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise. Further, as used in the description herein and throughout the claims that follow, the meaning of "each" does not require "each and every" unless the context clearly dictates otherwise. Finally, as used in the description herein and throughout the claims that follow, the meanings of "and" and "or" include both the conjunctive and disjunctive and may be used interchangeably unless the context expressly dictates otherwise; the phrase "exclusive of" may be used to indicate situations where only the disjunctive meaning may apply.

It is claimed:

1. A method for reducing noise from an input signal to generate a noise-reduced output signal, the method comprising:

receiving an input signal;

transforming the input signal from a time domain to a plurality of subbands in a frequency domain, wherein each subband of the plurality of subbands includes a speech component and a noise component;

for each of the subbands, estimating an amplitude of the speech component based on a of minimization of a normalized mean square error, wherein the normalized mean squared error is based on a mean squared error represented by $E[(A-\hat{A})|Y]$, where $\hat{A}$ is an estimate of the amplitude of the speech component, A represents an actual value of the amplitude of the speech component, Y is the amplitude of the subband, and E is an expected value operator; and filtering the plurality of subbands in the frequency domain based on the estimated amplitudes of the speech components to generate the noise-reduced output signal.

2. The method of claim 1, wherein estimating an amplitude of the speech component is based on at least one signal-to-noise ratio (SNR) of the subband, and wherein the estimate of the at least one SNR of the subband includes:

an estimate of an a posteriori SNR of the subband, and an estimate of an a priori SNR of the subband.

3. The method of claim 2, wherein the estimating of the amplitude of the speech component of the subband is based on a first value divided by the estimate of the a posteriori SNR of the subband, wherein the first value is based on a product of the estimate of the a posteriori SNR and the estimate of the a priori SNR of the subband.

4. The method of claim 2, wherein the estimating of the amplitude of the speech component of the subband is based on $$\hat{A} = \frac{\left|\sqrt[2]{v(1+v)}\right|}{\gamma}|Y|,$$

where $\hat{A}$ is an estimate of the amplitude of the speech component of the subband, $\gamma$ is the estimate of the a posteriori SNR of the subband, Y is the amplitude of the subband, and $\nu$ is $$v = \frac{\xi}{1+\xi}\gamma,$$

where $\xi$ is the estimate of the a priori SNR of the subband.

5. The method of claim 4, wherein the estimate of the a priori SNR of the subband is based on $$\xi = \frac{\lambda_X}{\lambda_N},$$

where $\lambda_X$ is a variance of the speech component of the subband, $\lambda_N$ is a variance of the noise component of the subband, and wherein the estimate of the a posteriori SNR of the subband is based on $$\gamma = \frac{|Y|^2}{\lambda_N}.$$

6. The method of claim 1 comprising:

segmenting the input signal into a plurality of frames, wherein the transforming of the input signal from the time domain to the plurality of subbands in the frequency domain generates subbands for each frame of the plurality of frames; and transforming the noise-reduced output signal from the frequency domain to the time domain.

7. The method of claim 1, wherein the minimization of the normalized mean squared error includes a determination of a value of $\hat{A}$ that minimizes $$\frac{E\left[\left(A-\hat{A}\right)^2 \mid Y\right.}{E[A \mid Y] * E\left[\hat{A} \mid Y\right])}$$

where $E[A|Y]*E[\hat{A}|Y]$ is a term that normalizes the mean squared error represented by $E[(A-\hat{A})^2|Y]$.

8. The method of claim 1, wherein an amplitude of each subband of the plurality of subbands is determined directly from the frequency domain representation of the input signal.

9. The method of claim 8, wherein the amplitude of each subband of the plurality of subbands is not determined based on an estimation.

10. The method of claim 1, wherein the estimating of the amplitude of the speech component is not based on a gamma function, wherein the estimating of the amplitude of the speech component is not based on a Bessel function, and wherein the estimating of the amplitude of the speech component is not based on an exponential function.

11. A system for reducing noise from an input signal to generate a noise-reduced output signal, the system comprising:

a time-to-frequency transformation device configured to transform an input signal from a time domain to a plurality of subbands in the frequency domain, wherein each subband of the plurality of subbands includes a speech component and a noise component;

a filter coupled to the time-to-frequency device, the filter being configured to:

for each of the subbands, estimate an amplitude of the speech component based on a minimization of a normalized mean square error, wherein the normalized mean squared error is based on a mean squared error represented by $E[(A-\hat{A})|Y]$, where $\hat{A}$ is an estimate of the amplitude of the speech component, A represents an actual value of the amplitude of the speech component, Y is the amplitude of the subband, and E is an expected value operator, and filter the plurality of subbands in the frequency domain based on the estimated amplitudes of the speech components to generate the noise-reduced output signal; and a frequency-to-time transformation device configured to transform the noise-reduced output signal from the frequency domain to the time domain.

12. The system of claim 11, wherein estimating an amplitude of the speech component is based on at least one signal-to-noise ratio (SNR) of the subband, and wherein the estimate of the at least one SNR of the subband includes:

an estimate of an a posteriori SNR of the subband, and an estimate of an a priori SNR of the subband.

13. The system of claim 12, wherein the estimating of the amplitude of the speech component of the subband is based on a first value divided by the estimate of the a posteriori SNR of the subband, wherein the first value is based on a product of the estimate of the a posteriori SNR and the estimate of the a priori SNR of the subband.

14. The system of claim 12, wherein the estimating of the amplitude of the speech component of the subband is based on $$\hat{A} = \frac{\left|\sqrt[2]{v(1+v)}\right|}{\gamma}|Y|,$$

where Â is an estimate of the amplitude of the speech component of the subband, γ is the estimate of the a posteriori SNR of the subband, Y is the amplitude of the subband, and ν is $$v = \frac{\xi}{1+\xi}\gamma,$$

where ξ is the estimate of the a priori SNR of the subband.

15. The system of claim 14, wherein the estimate of the a priori SNR of the subband is based on $$\xi = \frac{\lambda_X}{\lambda_N},$$

where $\lambda_X$ is a variance of the speech component of the subband, $\lambda_N$ is a variance of the noise component of the subband, and wherein the estimate of the a posteriori SNR of the subband is based on $$\gamma = \frac{|Y|^2}{\lambda_N}.$$

16. The system of claim 11 comprising:

a frame segmenter configured to segment the input signal into a plurality of frames, wherein the transforming of the input signal from the time domain to the plurality of subbands in the frequency domain generates subbands for each frame of the plurality of frames.

17. The system of claim 11, wherein the minimization of the normalized mean squared error includes a determination of a value of Â that minimizes $$\frac{E\left[\left(A-\hat{A}\right)^2 \mid Y\right.}{E[A \mid Y] * E\left[\hat{A} \mid Y\right])}$$

where E[A|Y]*E[Â|Y] is a term that normalizes the mean squared error represented by $E[(A-\hat{A})^2|Y]$.

18. The system of claim 11, wherein the amplitude of the subband is determined directly from the frequency domain representation of the input signal, and wherein the amplitude of the subband is not determined based on an estimation.

19. The system of claim 11, wherein the estimating of the amplitude of the speech component is not based on a gamma function, wherein the estimating of the amplitude of the speech component is not based on a Bessel function, and wherein the estimating of the amplitude of the speech component is not based on an exponential function.

* * * * *